United States Patent [19]

Bice

[11] Patent Number: 4,930,240

[45] Date of Patent: Jun. 5, 1990

[54] GUN BARREL CLEANING DEVICE

[76] Inventor: Kenneth R. Bice, 1042 Mo. Ave., Deerlodge, Mont. 59722

[21] Appl. No.: 442,632

[22] Filed: Nov. 29, 1989

[51] Int. Cl.[5] ..... F41A 29/02

[52] U.S. Cl. ..... 42/95; 15/104.09; 15/104.165; 403/342

[58] Field of Search ..... 15/104.09, 104.165; 42/95; 403/342, 343

[56] References Cited

U.S. PATENT DOCUMENTS

| | | | |
|---|---|---|---|
| 276,660 | 5/1883 | Birch | 15/104.165 |
| 602,937 | 4/1898 | Egli . | |
| 1,556,494 | 10/1925 | Cooper . | |
| 3,208,302 | 9/1965 | Lewis et al. . | |
| 3,286,293 | 11/1966 | Eckert . | |
| 3,602,935 | 9/1971 | McDonnell et al. | 15/104.09 |
| 3,609,790 | 9/1971 | Butch | 15/104.165 |
| 4,509,223 | 4/1985 | Sipple et al. . | |
| 4,674,218 | 6/1987 | Bottomley . | |
| 4,726,137 | 2/1988 | Zurek et al. . | |

FOREIGN PATENT DOCUMENTS 3714030 12/1988 Fed. Rep. of Germany ..... 42/95

*Primary Examiner*—Charles T. Jordan
*Assistant Examiner*—Richard W. Wendtland
*Attorney, Agent, or Firm*—Jerry T. Kearns

[57] ABSTRACT

A gun barrel cleaning device includes an elongated shaft having a driving head at one end dimensioned for engagement with a battery powered reversible electric screw driver. One of a variety of available cleaning implements is secured to the shaft through a pair of cooperating threaded fasteners. An elongated extension shaft may be employed depending upon the length of a gun barrel to be cleaned. The fasteners form a rotary driving connection which enable the cleaning implement to be rotated in either a forward or reverse direction within a gun barrel. The cleaning implement may take the form of a rotary brush having a spiral bristle array with a pitch corresponding to the rifling groove pitch of a barrel to be cleaned, a slotted holder for a fabric cleaning patch, or a conical threaded bullet extractor.

9 Claims, 3 Drawing Sheets

GUN BARREL CLEANING DEVICE

BACKGROUND OF THE INVENTION

1. Field of the Invention

The present invention relates to gun barrel cleaning devices, and more particularly pertains to a gun barrel cleaning device adapted for use with a conventional reversible battery powered electric screw driver to provide an expedient power driven cleaning tool.

2. Description of the Prior Art

Various types of gun barrel cleaning devices are known in the prior art. A typical example of such a gun barrel cleaning device is to be found in U.S. Pat. No. 602,937, which issued to H. Egli on April 26, 1898. This patent discloses an elongated shaft having a handle at one end and a brush at an opposite end. A plurality of threaded extensions may be utilized to form a tool to any desired length. U S. Pat. No. 1,556,494, which issued to G. Cooper on Oct. 6, 1925, discloses a gun barrel cleaning tool which utilizes a plurality of interconnected threaded shafts and spiral brushes. U.S. Pat. No. 3,286,293, which issued to C. Eckert on Nov. 22, 1966, discloses a gun barrel cleaning device including an elongated shaft having a handle secured at one end and a spiral brush secured at an opposite end. An adjustable stop is securable to the shaft by a set screw for limiting an axial stroke of the brush within a gun barrel. U.S. Pat. No. 4,674,218, which issued to C. Bottomley on June 23, 1987, discloses a gun bore cleaning device including rods of various different diameters and a handle adaptable to each of the different rods. U.S. Pat. No. 4,726,137, which issued to R. Zurek et al on Feb. 23, 1988, discloses a cleaning device for guns in which a cleaning brush is fastened to a brush carrier and is moved in axial reciprocal motion within the barrel by means of an elongated rod. A drive unit including drive wheels is engageable with the rod in front of the muzzle of the gun to provide powered reciprocation of the cleaning brush.

While the above mentioned devices are directed to gun barrel cleaning devices, none of these devices disclose a gun barrel cleaning implement adapted for powered rotation through engagement with a conventional reversible battery powered electric screw driver. Additionally, none of the aforementioned devices include a rotary driving connection having an externally threaded stub portion provided with a central non-circular bore for receiving a driving lug member which is surrounded by an internally threaded rotationally mounted and axially fixed nut. Inasmuch as the art is relatively crowded with respect to these various types of gun barrel cleaning devices, it can be appreciated that there is a continuing need for and interest in improvements to such gun barrel cleaning devices, and in this respect, the present invention addresses this need and interest.

SUMMARY OF THE INVENTION

In view of the foregoing disadvantages inherent in the known types of gun barrel cleaning devices now present in the prior art, the present invention provides an improved gun barrel cleaning device. As such, the general purpose of the present invention, which will be described subsequently in greater detail, is to provide a new and improved gun barrel cleaning device which has all the advantages of the prior art gun barrel cleaning devices and none of the disadvantages.

To attain this, representative embodiments of the concepts of the present invention are illustrated in the drawings and make use of a gun barrel cleaning device which includes an elongated shaft having a driving head at one end dimensioned for engagement with a battery powered reversible electric screw driver. One of a variety of available cleaning implements is secured to the shaft through a pair of cooperating threaded fasteners. An elongated extension shaft may be employed depending upon the length of a gun barrel to be cleaned. The fasteners form a rotary driving connection which enable the cleaning implement to be rotated in either a forward or reverse direction within a gun barrel. The cleaning implement may take the form of a rotary brush having a spiral bristle array with a pitch corresponding to the rifling groove pitch of a barrel to be cleaned, a slotted holder for a fabric cleaning patch, or a conical threaded bullet extractor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gun barrel cleaning device which has all the advantages of the prior art gun barrel cleaning devices and none of the disadvantages.

It is another object of the present invention to provide a new and improved gun barrel cleaning device which may be easily and efficiently manufactured and marketed.

It is a further object of the present invention to provide a new and improved gun barrel cleaning device which is of a durable and reliable construction.

An even further object of the present invention is to provide a new and improved gun barrel cleaning device which is susceptible of a low cost of manufacture with regard to both materials and labor, and which accordingly is then susceptible of low prices of sale to the consuming public, thereby making such gun barrel cleaning devices economically available to the buying public.

Still yet another object of the present invention is to provide a new and improved gun barrel cleaning device which provides in the apparatuses and methods of the prior art some of the advantages thereof, while simultaneously overcoming some of the disadvantages normally associated therewith.

Still another object of the present invention is to provide a new and improved gun barrel cleaning device adapted to provide powered rotation of a cleaning implement.

Yet another object of the present invention is to provide a new and improved gun barrel cleaning device having an improved threaded rotary driving connection between extension shafts and cleaning implements.

Even still another object of the present invention is to provide a new and improved gun barrel cleaning device including a bullet extractor attachment for removing bullets lodged within gun barrels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
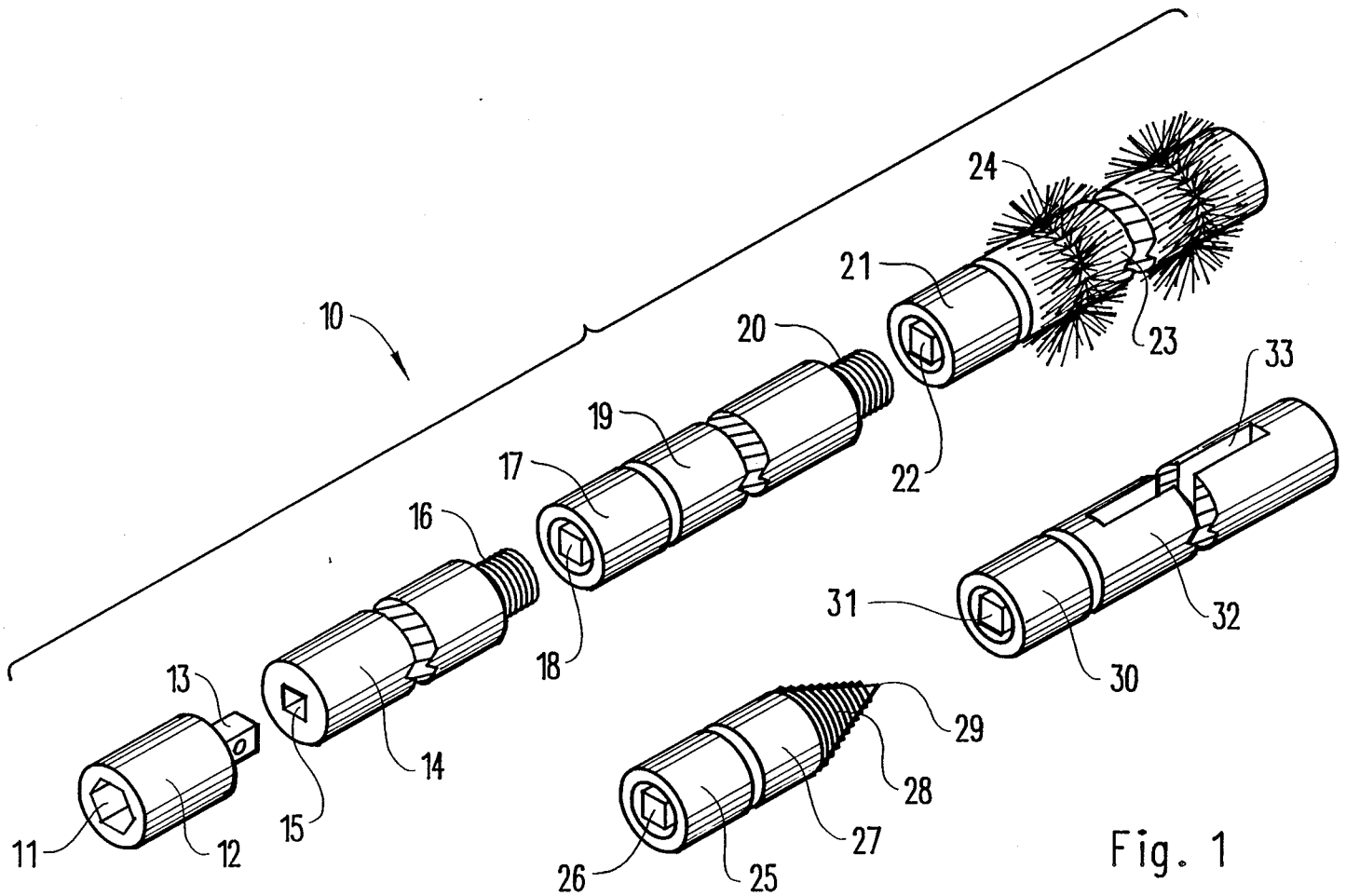
FIG. 1 is an exploded perspective view, partially cut away, illustrating the various components of the gun barrel cleaning device of the present invention.

With reference now to the drawings, and in particular to FIG. 1 thereof, a new and improved gun barrel cleaning device embodying the principles and concepts of the present invention and generally designated by the reference numeral 10 will be described.

More specifically, it will be noted that the first embodiment 10 of the invention includes an elongated shaft 14, the major portion of which has been cut away for purposes of illustration, having a square socket or aperture 15 provided at one end. A driving head 12 has a complementary rectangular lug 13 dimensioned for driving engagement within the socket 15. An opposite end of the driving head 12 is provided with a hexagonal recess 11 adapted for engagement with the rotary output shaft of a conventional battery powered reversible electric screw driver. An opposite end of the shaft 14 is provided with a reduced diameter externally threaded stub portion 16. The stub portion 16 has a central square recess or aperture dimensioned for engagement with a rectangular lug 18 formed at one end of an extension shaft 19. An internally threaded nut 17 is mounted for rotation around the lug 18, but is constrained against axial movement relative thereto. The nut 17 is dimensioned for threaded engagement with the stub portion 16 to provide a reinforced rotary driving connection. An opposite end of the extension shaft 19 is provided with a similar reduced diameter externally threaded stub portion 20 including a rectangular recess or aperture dimensioned for engagement with a rectangular lug 22 formed at one end of an elongated cylindrical brush body 23. The lug 22 is surrounded by an axially fixed, rotationally mounted internally threaded nut 21 configured for threaded engagement with the stub portion 20. The elongated cylindrical brush body 23 is preferably provided with a metallic bristle array 24 having a spiral pitch corresponding to the pitch of rifling grooves provided within a gun barrel to be cleaned. Thus, the brush 23 and corresponding bristle array 24 may be provided in a variety of different dimensions and spiral pitches for use with various different firearm calibers. Similarly, the diameter of the shafts 14 and 19 may be similarly varied, depending upon the caliber of the gun to be cleaned. As an alternative to the brush 23, a slotted cylindrical attachment 32 may be employed The slotted attachment 32 includes a rectangular lug 31 surrounded by an axially fixed and rotational internally threaded nut 30. An elongated slot 33 is formed through the cylindrical body 32 and is adapted for insertion of a conventional fabric cleaning patch which may be utilized to apply various cleaning solvents during a gun barrel cleaning process. In order to remove bullets which may become lodged within the barrel of a gun, a bullet extractor attachment 27 may be utilized. The bullet extractor 27 has a conical tip portion 28 terminating at a pointed end 29. The conical portion 28 is provided with an external spiral thread such that rotation of the extractor 27 causes the pointed tip 29 to be driven into a lodged bullet, in the manner of a screw. Subsequently, an axial retraction force may be applied to dislodge the bullet. The extractor attachment 27 includes a rectangular lug 26 and rotational nut 25 to form a secure rotary driving connection to the shaft 14 or extension shaft 19.

Figure 2:
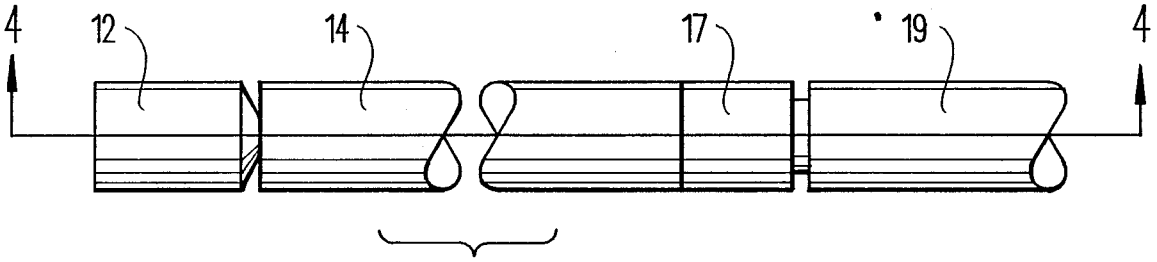
FIG. 2 is a partial side view illustrating the gun barrel cleaning device of the present invention.

FIG. 2 is a side view illustrating the driving head 12 in engagement with the shaft 14.

Figure 3:
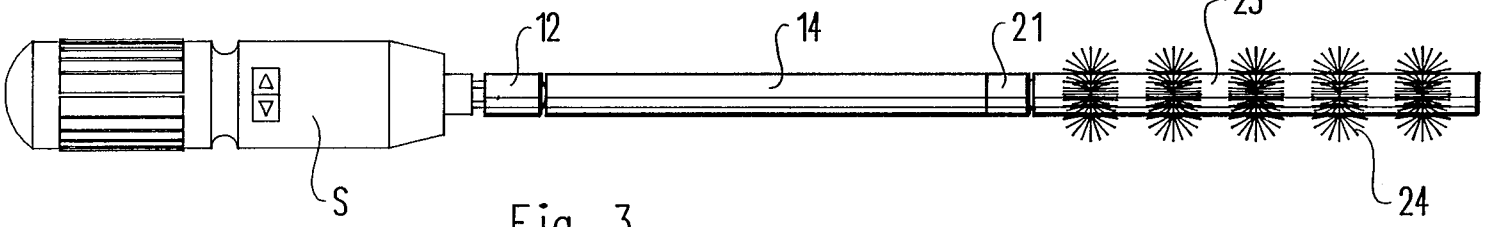
FIG. 3 is a side view illustrating the use of a conventional battery powered electric reversible screw driver in conjunction with the gun barrel cleaning device of the present invention.

FIG. 3 illustrates the brush 23 directly connected to the shaft 14, with the extension shaft omitted. It should be noted that one or a plurality of extension shafts may be employed, to adapt the tool for use with guns of various different barrel lengths. A conventional reversible electric battery operated screw driver S is preferably utilized to impart a rotary driving force to the driving head 12. The reversible nature of the screw driver S allows the spiral brush 23 to be rotated in reverse directions for axial movement in opposite directions.

Figure 4:
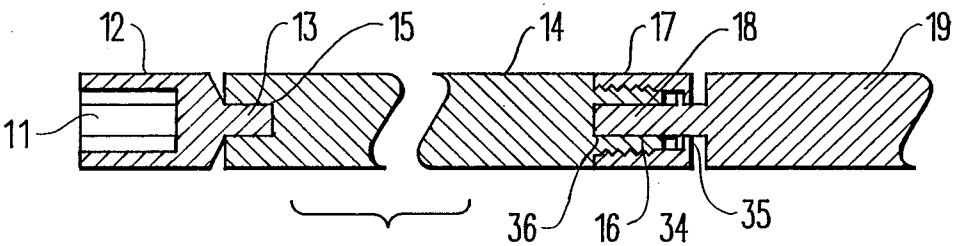
FIG. 4 is a cross sectional view, taken along line 4—4 of FIG. 2.

FIG. 4 is a cross sectional view, taken along line 4—4 of FIG. 2, which illustrates the details of the rotary driving threaded connection. The nut 17 is of a hollow, cylindrical configuration and is provided with an aperture 35 formed through a circular end wall thereof. The rectangular lug 18 is illustrated inserted within a rectangular recess or aperture 36 formed centrally within the stub portion 16. The nut 17 has internal threads in mesh with external threads provided on the stub portion 16 to form a secure threaded connection. The lug 18 is provided with a circular radially extending flange 34 received within the nut 17. The nut 17 is thus constrained against axial movement by the flange 34, but is allowed to rotate freely about the lug 18. The nut 17 may be formed about the lug 18 by suitable forging operations, or alternatively the flange 34 may be formed as a separate element secured to the lug 18 after assembly of the nut 17 thereon.

Figure 5:
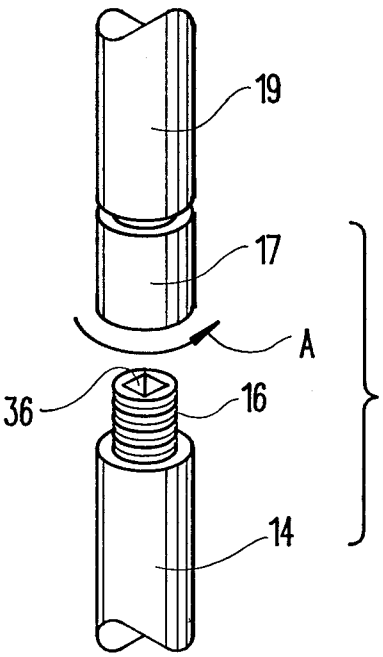
FIG. 5 is an exploded perspective view illustrating the threaded driving connection utilized for securing various components of the gun barrel cleaning device of the present invention.

FIG. 5 illustrates the manner of connecting the extension shaft 19 to the shaft 14. The rotarY nut 17 is rotated in a selected direction as indicated by the arrow A to effect threaded engagement between the nut 17 and the stub portion 16.

Figure 6:
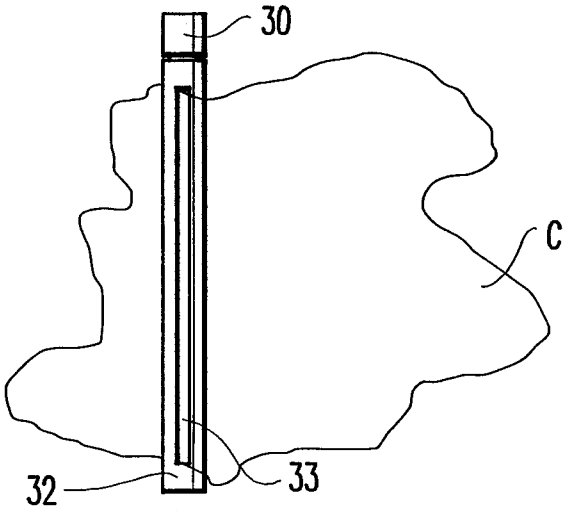
FIG. 6 is a side view illustrating a cleaning implement attachment for utilizing fabric cleaning patches.

As shown in FIG. 6, the slotted attachment 32 may be utilized with a conventional cleaning patch C.

Figure 7:
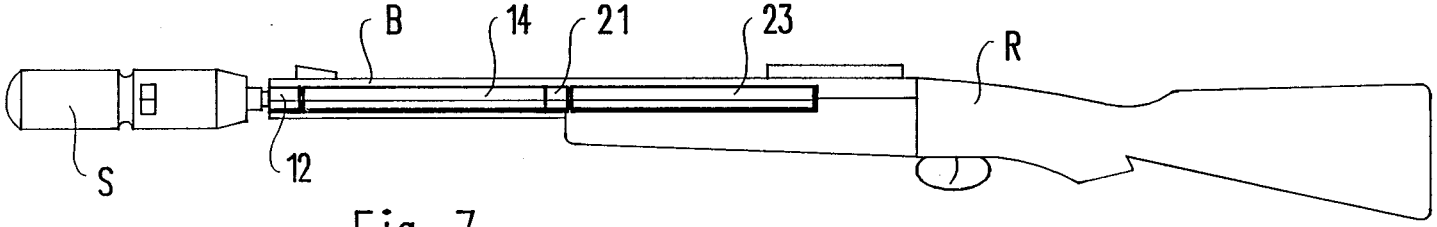
FIG. 7 is a diagrammatic side view illustrating the manner of using the gun barrel cleaning device of the present invention.

FIG. 7 diagrammatically illustrates the manner of use of the cleaning tool according to the present invention. The brush 23 is secured by the nut 21 at a distal end portion of the shaft 14. Rotation of the driving head 12 by the screw driver S thus imparts a rotation to the brush 23 in a selected direction. The screw driver S is then manually moved axially to traverse the brush 23 along the length of the barrel B of the rifle R. It should be noted that a plurality of extension shafts may be employed, depending upon the length of the barrel B.

As may now be understood, the present invention provides an inexpensive yet expedient gun barrel cleaning device which allows the use of a conventional electric screw driver to afford a portable and powered rotary cleaning implement. Additionally, the present invention may be utilized to extract bullets lodged within a gun barrel.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the U.S. is as follows:

1. A gun barrel cleaning device, comprising:

an elongated shaft;

a driving head at one end of said shaft dimensioned for engagement with a battery powered reversible electric motor;

an implement for removing contaminants from a gun barrel;

a first fastener on said shaft and a second cooperating fastener on said implement forming a rotary driving connection between said shaft and said implement;

one of said first and second fasteners comprising a reduced diameter externally threaded stub portion, an elongated non-circular aperture formed in said stub portions; and the other of said first and second fasteners comprising an elongated non-circular lug member dimensioned for insertion within said non-circular aperture, an internally threaded nut mounted for free relative rotation around said lug member and constrained against axial movement relative thereto, said nut configured for threaded engagement with said stub portion.

2. The gun barrel cleaning device of claim 1, wherein said implement comprises a brush having an elongated cylindrical body provided with a spiral bristle array.

3. The gun barrel cleaning device of claim 2, wherein said spiral bristle array has a pitch corresponding to a rifling groove pitch of a gun barrel to be cleaned.

4. The gun barrel cleaning device of claim 1, wherein said implement comprises an elongated body member having a slot for retaining a cleaning patch.

5. The gun barrel cleaning device of claim 1, wherein said implement comprises a pointed conical member having an external helical thread for extracting a bullet lodged within a gun barrel.

6. The gun barrel cleaning device of claim 1, further comprising an elongated extension provided with fasteners for connection between said shaft and said implement.

7. A rotary driving connector for removably securing first and second members of a gun barrel cleaning device, comprising:

a first fastener on said first member and a second cooperating fastener on said second member;

one of said first and second fasteners comprising a reduced diameter externally threaded stub portion, an elongated non-circular aperture formed in said stub portions; and the other of said first and second fasteners comprising an elongated non-circular lug member dimensioned for insertion into said non-circular aperture, an internally threaded nut mounted for free relative rotation around said lug member and constrained against axial movement relative thereto, said nut configured for threaded engagement with said stub portion.

8. The gun barrel cleaning device of claim 7, wherein said non-circular aperture and said non-circular lug member have mating polygonal transverse cross sectional shapes.

9. The gun barrel cleaning device of claim 7, wherein said non-circular aperture and said non-circular lug member are coaxially formed with respect to said first and second members.

* * * * *